US005259770A

United States Patent [19]

Bates et al.

[11] Patent Number: 5,259,770

[45] Date of Patent: Nov. 9, 1993

[54] IMPEDANCE CONTROLLED ELASTOMERIC CONNECTOR

[75] Inventors: Warren A. Bates; David C. Johnson, both of Winston-Salem; Keith L. Volz, Jamestown, all of N.C.

[73] Assignee: AMP Incorporated, Harrisburg, Pa.

[21] Appl. No.: 854,123

[22] Filed: Mar. 19, 1992

[51] Int. Cl.[5] ..... H01R 9/09

[52] U.S. Cl. ..... 439/66; 439/67

[58] Field of Search ..... 439/66, 65, 86, 91, 439/74, 67, 77, 493, 591

[56] References Cited

U.S. PATENT DOCUMENTS 3,985,413 10/1976 Evans ..... 339/17 LM
4,057,311 11/1977 Evans ..... 339/17 M
4,693,530 9/1987 Stillie et al. ..... 439/67
4,902,606 2/1990 Patraw ..... 439/66 X
4,999,460 3/1991 Sugiyama et al. ..... 439/66 X
5,001,302 3/1991 Atsumi ..... 439/91 X

*Primary Examiner*—Neil Abrams
*Attorney, Agent, or Firm*—William B. Noll

[57] ABSTRACT

An impedance controlled elastomeric connector (10) includes signal contacts (30) and ground contacts (40) with leads (32, 42) and a ground plane (25) formed of conductive foil (24) laminated to a dielectric and insulating film (18) folded around an elastomeric core (12) with the signal, ground spacing and the dielectric constant and thickness of the film selected to provide controlled impedance signal paths through the connector as compressed between components (2, 6).

5 Claims, 4 Drawing Sheets

IMPEDANCE CONTROLLED ELASTOMERIC CONNECTOR

This invention relates to an impedance controlled elastomeric connector for interconnecting densely spaced micro strip transmission paths and the like.

BACKGROUND OF THE INVENTION

Elastomeric connectors have been developed to interconnect the closely spaced circuits of substrates and printed circuit boards and the like through the use of contacts that are fabricated by etching away thin copper foil from an insulating film carrying support, which in turn is wrapped around an elastomeric body. Upon compression, the elastomeric body drives the contacts into engagement with contact pads or traces on substrates or printed circuit boards. One such device is shown in U.S. Pat. No. 3,985,413 granted Oct. 12, 1976. Another is shown in U.S. Pat. No. 4,057,311 granted Nov. 8, 1977. These connector concepts allow interconnection of circuit paths on spacings far less than 0.050 inches, spacings on the order of 0.025 inches or less and provide a low resistance, stable interface of large numbers of interconnections with minimum path lengths to reduce the impedance presented by the connectors.

As transmission speeds increase, rise time of signal pulses decreases and traditional single conductor power and signal circuits no longer work adequately; the lack of impedance control causing circuit ringing, signal delays and losses, reflections, as well as creating cross-talk between signal lines. With certain signal transmission problems in circuit boards, such as printed circuit boards, resort has been made to strip line and micro strip line techniques. There, ground planes are positioned relative to signal lines in terms of spacing, and dielectric constant parameters to control the impedance of circuit transmission to and from a functioning component, such as integrated circuits and input and output transmission lines.

Alternatively, resort has been made to compensating connector segments to provide impedance matching, and a variety of other techniques, generally large in size and complicated in structure and assembly.

Accordingly, it is an object of the present invention to provide an elastomeric connector having a controlled impedance to match the impedances utilized by the circuits, substrates, or printed circuit boards and the like, interconnected by such connector. It is a further object to provide a simple and reliable elastomeric connector having controlled impedance characteristics and capable of interconnecting large numbers of closely spaced circuit paths. It is still a further object to provide an improved controlled impedance connector that is small in size and presents physically and electrically a reduced path length of interconnection.

SUMMARY OF THE INVENTION

The present invention features an impedance control connector that is comprised of a layer of thin, soft conductive foil laminated to a thin, insulating and dielectric film. The foil defines signal conductors spaced apart in an appropriate spacing for interconnection with circuit or substrate contact pads or traces, and a ground plane interconnected to grounding leads with contacts extended between each signal contact. The foil/film structure is folded in a way to position the ground plane precisely overlying the signal leads and contacts and the ground leads and contacts to define a micro strip having a controlled impedance selected to be compatible with the impedance of the devices, circuits or substrates served by the connector. The folded foil/film structure is wrapped around a tubular elastomeric body of insulating resilient material to define rows of signal and ground contacts positioned on the top and bottom surfaces of the body and extending along the length of the body. The connector formed thereby is positioned between the substrates or circuits, which are driven to compress the elastomeric body which in turn physically drives the contacts, signal and ground, against appropriate signal and ground contacts of the substrates or circuits to be interconnected with a sufficient normal force to assure a stable, low-resistance interface between the substrate and circuit paths. The invention contemplates the provision of a ground plane which is solid across its area and also a ground plane which is latticed or perforated to reduce the stiffness and facilitate a ready bending and deformation to allow the functioning of the elastomeric body. The invention contemplates fabrication utilizing flat etched circuitry folded and rolled around the elastomeric body with the signal and ground contacts formed with precision through photolithography or selective plating to achieve the proper spacing for controlled impedance.

IN THE DRAWINGS

DETAILED DESCRIPTION OF THE INVENTION

Reference is made to the following publication, which is incorporated herein by reference as a generalized teaching related to signal transmission and the concepts of strip line and micro strip line structures, calculations pertaining to the terms utilized in the present specification, and as general background to the subject: *Reference Data for Engineers; Radio, Electronic, Computer and Communications* by Edward C. Jordan, Editor-in-Chief, Howard W. Samms and Company, Seventh Edition, Fourth Printing, 1988.

Figure 7:
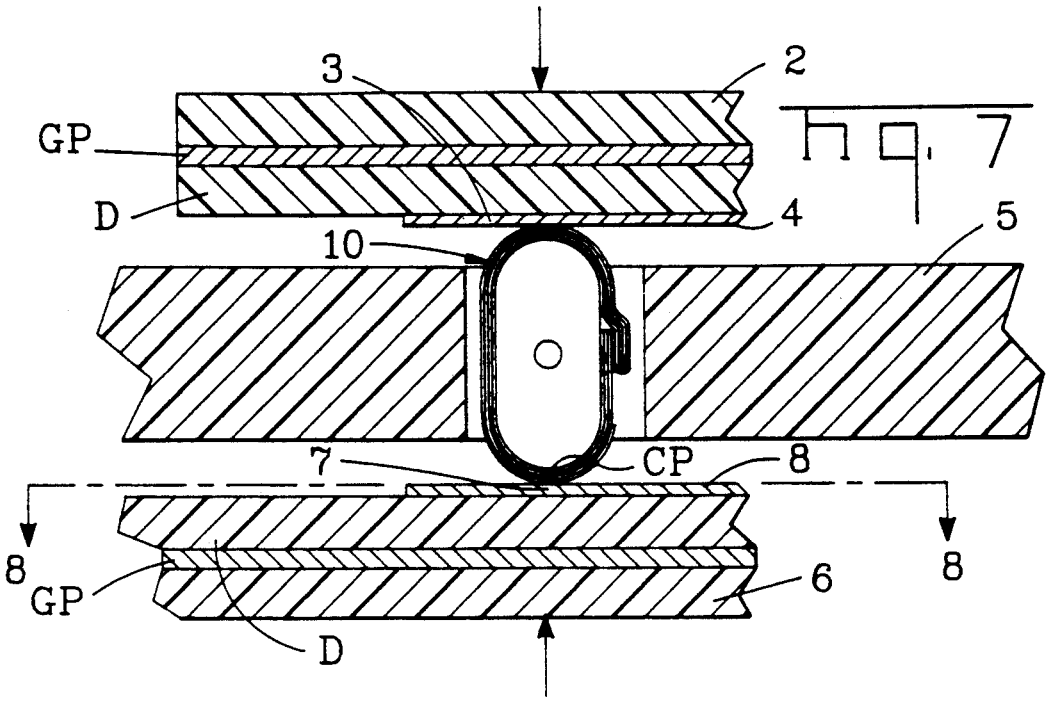
FIG. 7 is a side, sectional, and elevational view showing the connector of the invention in use interconnecting a pair of circuits.
Figure 8:
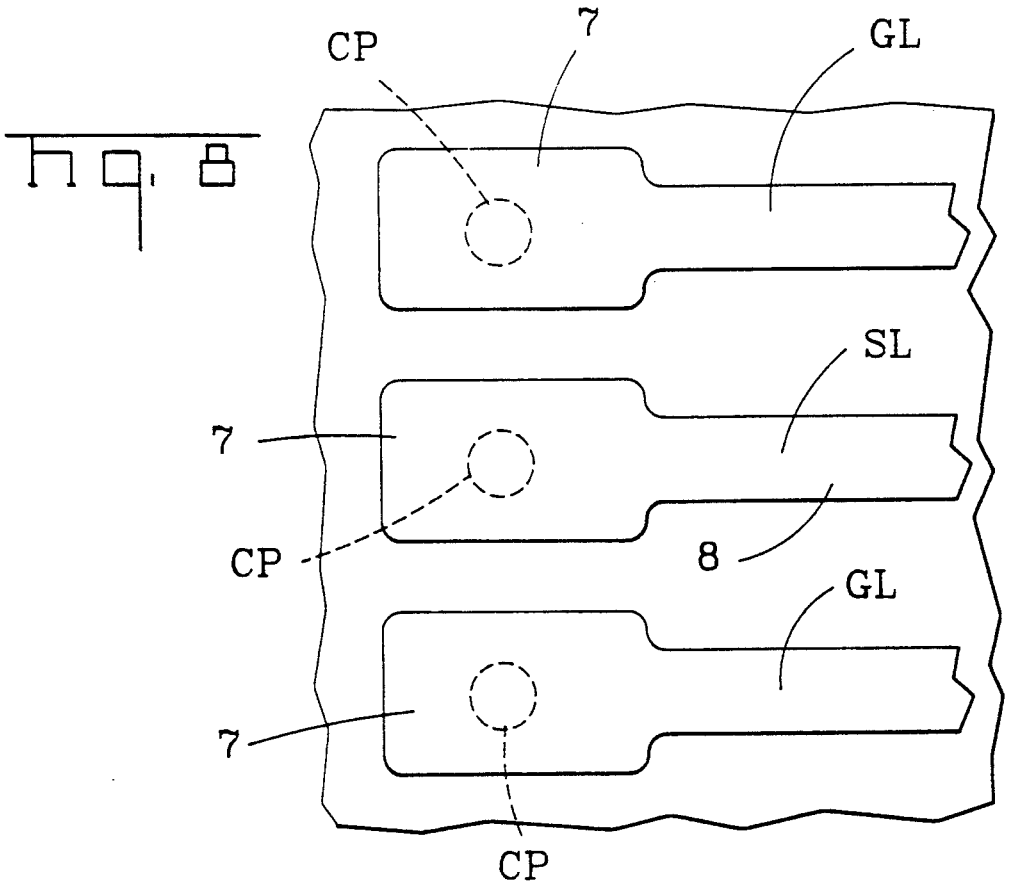
FIG. 8 is a plan view, of a section of the structure shown in FIG. 7 taken through lines 8—8.

Referring first to FIGS. 7 and 8, a pair of substrates 2 and 6, which may be thought of as printed circuit boards, flexible circuit boards, components, including integrated circuits or the like are shown. These substrates each include a micro strip line formed of a ground plane GP, a thin conductive foil embedded in a dielectric material D carrying spaced therefrom on one surface, a micro strip line lead 4, with respect to substrate 2, and a micro lead line 8, shown with respect to substrate 6. The thickness of the dielectric material D between the ground planes GP and the lead lines 4 and 8 is selected relative to the dielectric constant of such material to provide a precise impedance for the substrates which form a micro strip transmission line. Energy is propagated in accordance with micro strip concepts along the ground plane and micro strip line lead, within the dielectric material in accordance with that mode of energy propagation associated with the frequency of the signal involved, RF or pulse. Characteristic impedances of such lines on the order of 30, 50, 70, or other ohmic values, are well understood, well known, and widely used to interconnect signal generating and receiving circuits such as those integrated circuits and transmission lines employed with high speed communication, computer, or other signal processing equipment.

Typically, substrates such as 2 and 6 must be interconnectable so that one may be displaced relative to the other for repair, replacement, or at least for initial assembly. Interconnection of substrates utilize a connector 10 which interconnects the different transmission paths, ground line leads GL and signal leads SL, leads 8 being shown in FIGS. 7 and 8. As can be discerned, leads 8 end in contact pads 7 that are somewhat broader than leads 8 to accommodate interconnection. Shown also in FIG. 8 in phantom are contact points CP that represent the contact points of engagement by connector 10. The leads 4 of substrate 2 similarly end in the contact pads 3 and are engaged similarly by connector 10. The connector 10 in FIG. 7, represents the connector of the invention, looking at a section of what is in fact a tubular configuration held within an insulating substrate 5 to be engaged by the pads 3 and 7. In accordance with preferred practice, substrates 2 and 6 are driven together along the arrowed lines shown to compress connector 10, the elastomeric body therewithin to be described, and force the conductive portions into engagement with the contact points CP and provide an interconnection. The path of interconnection can be observed as a dotted line in FIG. 7 to be slightly greater than a direct line but relatively short in terms of the dimensions of the connector and the spacings between the substrates. Additionally, the connector of the invention is intended to provide a controlled impedance, as close as is feasible to the impedance of the substrates utilizing micro strip line techniques.

Figure 1:
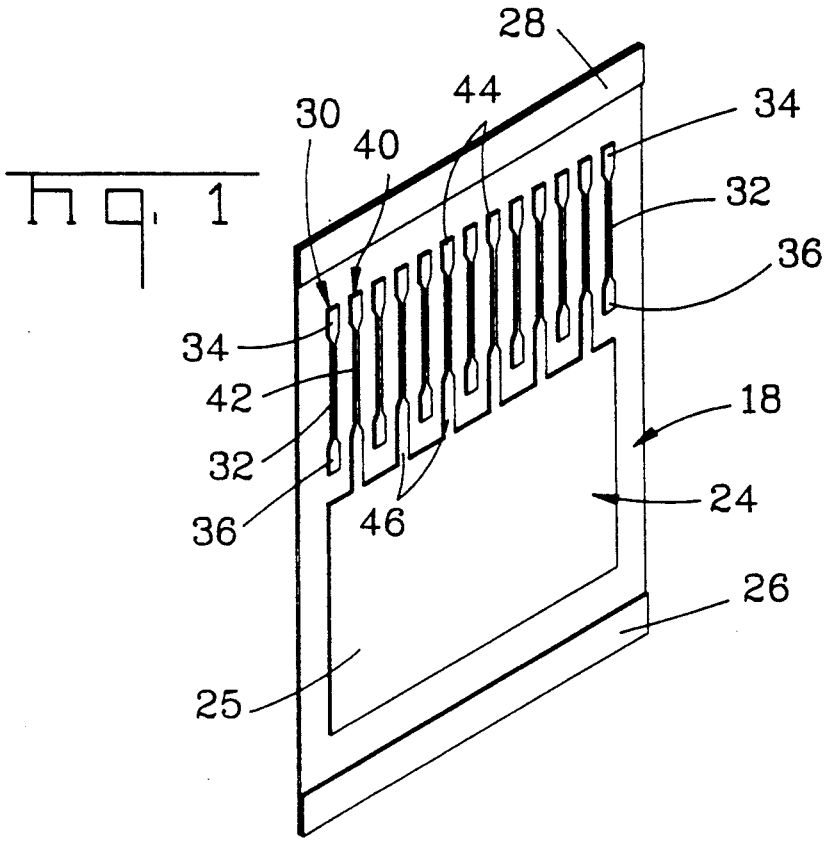
FIG. 1 is a perspective view, considerably enlarged from actual size, of a foil/film structure in an initial planar configuration.

Referring now to FIG. 1, a foil/film laminar structure, including a film 18, a thin, flexible dielectric film such as a polyamide, the foil 24 including a flat solid portion having lead lines extending therefrom and joined thereto. In FIG. 1, the invention may also be seen to include strips 26 and 28 at the end edges that represent parts of the foil left laminated to the film. The foil 24 is preferably a thin, soft copper foil, half-ounce or less, laminated to the film by a suitable adhesive. The foil is etched away to provide the configuration shown in FIG. 1 with the ground plane shown solidly, and a number of signal leads 30 spaced apart with a number of ground leads 40 therebetween. The spacing of the edge surfaces of the leads is made in accordance with the need to provide contacts on centers to mate with substrates as previously described with respect to 8; and, to provide control of cross-coupling and impedance between the ground leads and the signal leads. The signal leads 30 each include signal lead lines 32 having at the ends thereof integral foil contact pads 34 and 36. The ground leads 40 each include lead lines 42 having at the ends thereof, contact pads 44 and 46, the contact pads 46 joining a principal ground plane 25.

Figure 2:
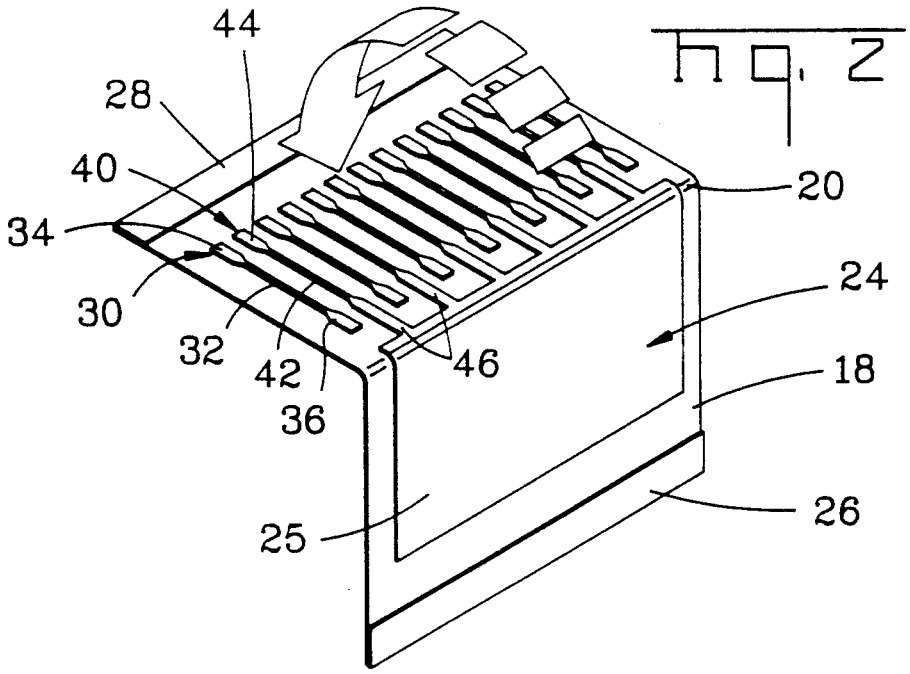
FIG. 2 is a perspective view of the foil/film structure of FIG. 1 following a first folding step.
Figure 3:
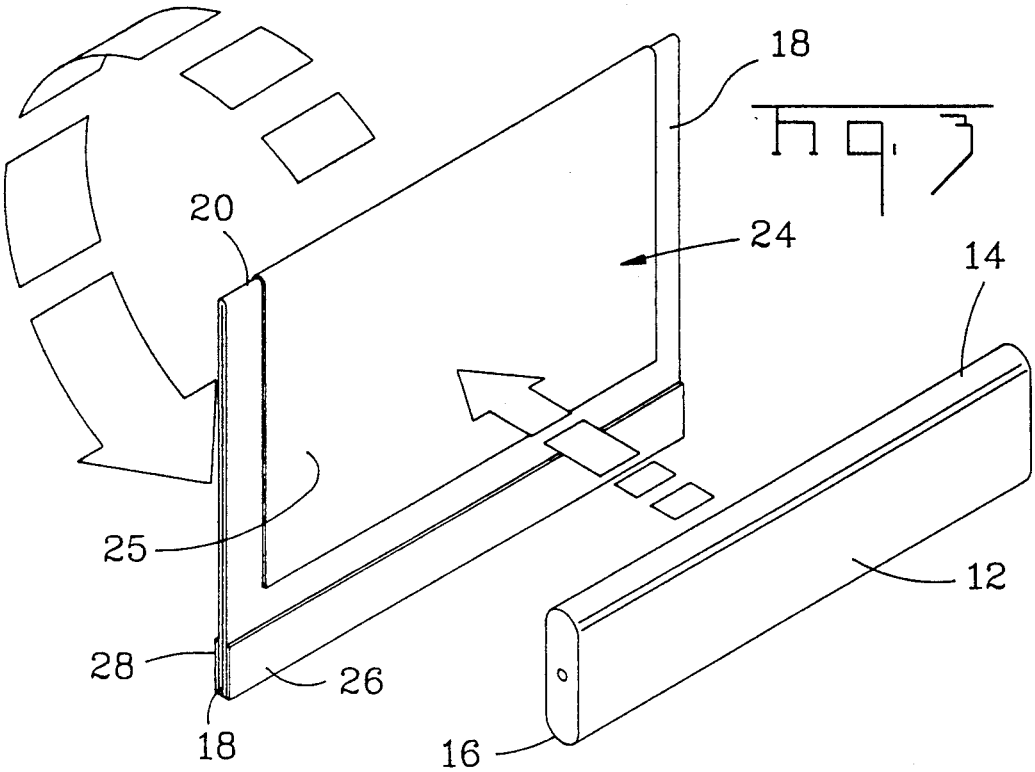
FIG. 3 is a perspective view of the film of FIG. 2 following a second folding step in conjunction with an elastomeric body prior to assembly.

As can be appreciated, the characteristics of the plastic film and the foil, both very thin, allow for a ready folding of the structure, and reference is made to FIG. 2, which shows the first step in folding, noting the bend at 20 as the first fold. FIG. 3 shows the next step of assembly, the structure shown in FIGS. 1 and 2, and additionally shows an elastomeric member 12 having curved top and bottom surfaces 14 and 16. The elastomeric member can be formed of a number of engineering plastic materials as by molding or extrusion to include a controlled resilience. Plastics such as silicone, urethane or polypropylene, in appropriate hardness and appropriate dielectric constant, may be employed. Reference is made to the aforementioned patents for teachings relative to appropriate materials for the elastomeric member and body 12.

Figure 4:
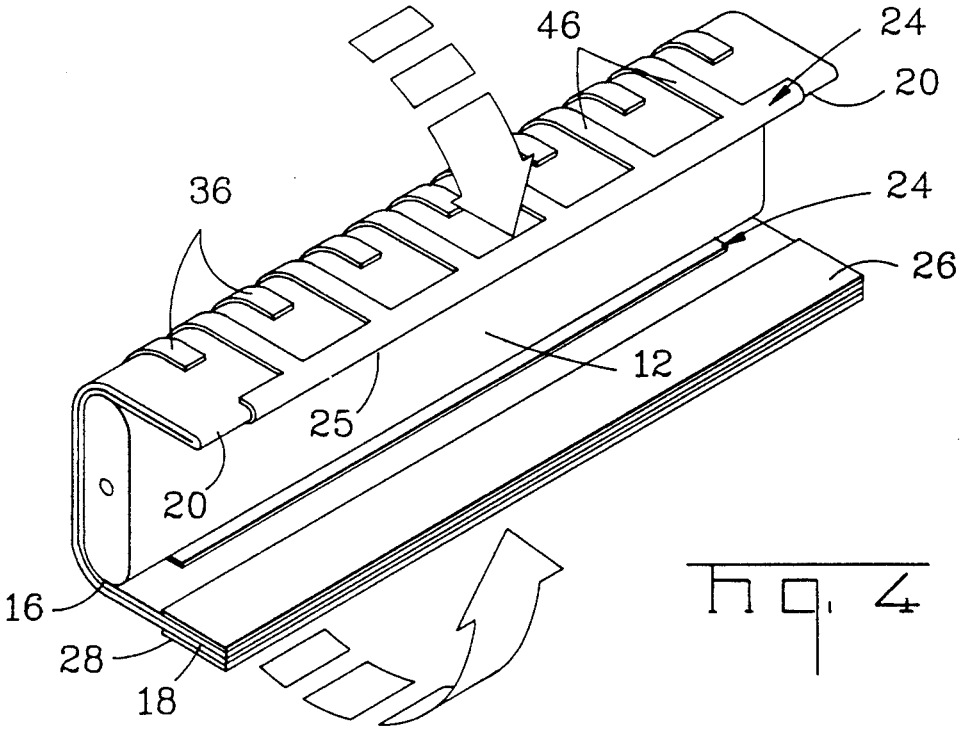
FIG. 4 is a perspective view of the elements of FIG. 3 with the foil/film partially wrapped around the elastomeric body.
Figure 5:
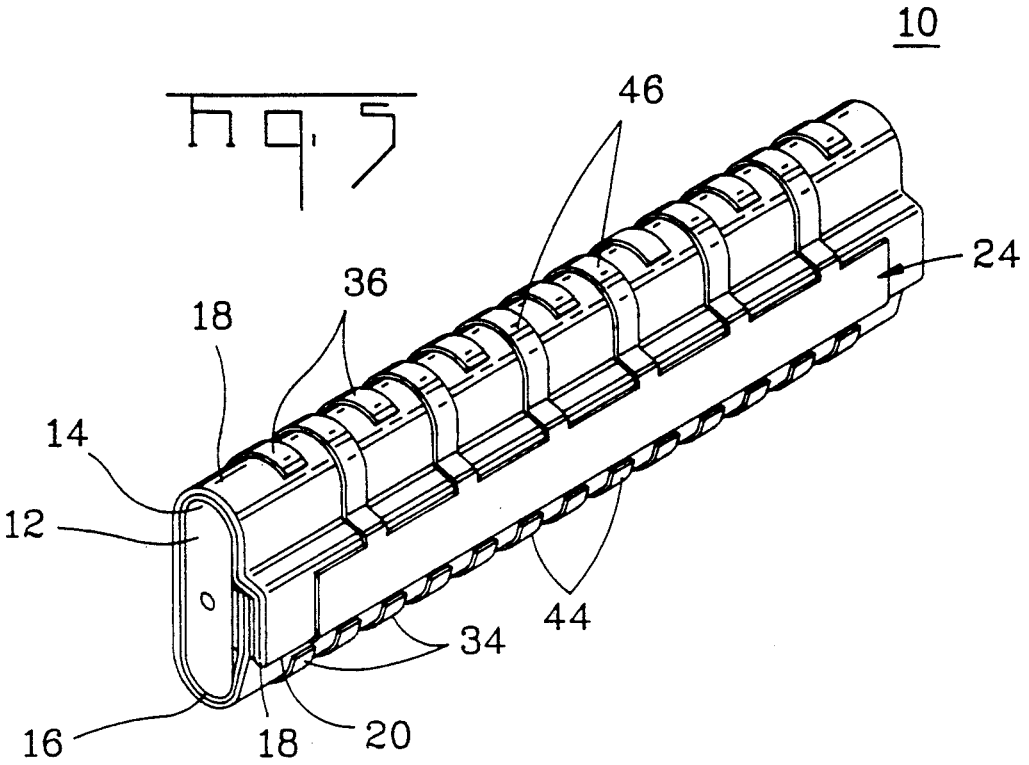
FIG. 5 is a perspective view of the connector of the invention showing the foil/film wrapped around the elastomeric body in a final form.

As can be discerned from FIG. 4, the folded shape shown in FIG. 3 is next wrapped around body 12, the metal portion of the ground plane and the leads serving to assure, an inelastic deformation holding the shape of the connector properly. The dimensions of the elastomeric body 12 are chosen so that the contacts of the signal and ground leads 30 and 40 are presented at the top and bottom of the connector. FIG. 4 shows the leads, including contacts 36 and 46 at the top of the connector. FIG. 5 shows the final configuration following final folding of connector 10, and as can be seen there, the contacts 36 and 46 reside at the top of the connector, and the contacts 34 and 44 reside at the bottom of the connector. As can be appreciated, the ground plane 25 extends inside the film and is engaged by the material of body 12. As can be also appreciated from FIG. 5, each of the contacts, pads and leads, is spaced precisely by the film, twice the thickness of the film from the ground plane. The spacing between the contacts and leads and the ground plane is thus controlled precisely along the length of the connector package.

Referring back to FIG. 7, the connector 10, forming in essence a micro strip line connector, is installed to interconnect the strip lines of substrate 2 and 6, the conductors, conductive leads, signal and ground, the contacts associated therewith, and the ground plane 25 is positioned from such leads by twice the thickness of the dielectric film. In this way, a controlled impedance connector can be made simply and compactly to provide desired interconnection having minimum transmission losses due to impedance discontinuities, signal reflections, cross-talk and the like.

Figure 6:
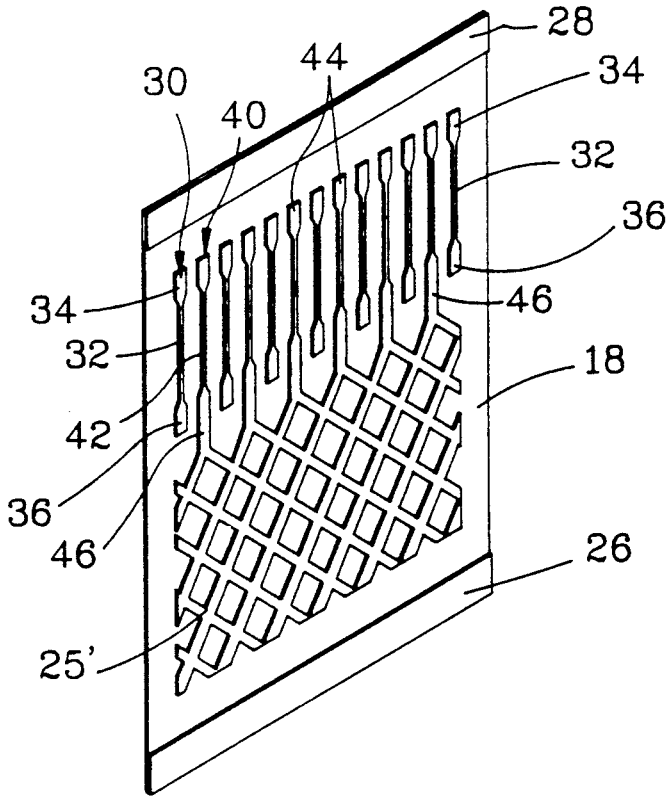
FIG. 6 is a perspective view of the foil/film structure, similar to that of FIG. 1, but including an alternative embodiment for the ground plane thereof.

FIG. 6 shows an alternative embodiment of the connector of the invention wherein the ground plane 25' is shown to be latticed, the latticing selected to reduce the bending forces of the ground plane and assist in a ready compression to effect an elastomeric interconnection of the various leads and contacts. It is to be understood that the latticing must take into consideration the purpose of the ground plane, not being too open as to appreciably alter the micro strip line characteristics. It is also to be appreciated that the lattice may be formed by holes or grids of various configurations etched into the foil material. The laminar and rolled and folded package forming the connector is intended to be readily deformable and compressible to develop normal forces driving the signal and ground contacts against the contact surfaces, contact point CP of the contacts 3 and 7, referring to FIG. 7, to effect a stable, low-resistance interface. For this reason, the connector package must be made resilient through an appropriate selection of film and foil and the characteristics of the elastomeric member or body 12.

While the connector 10 has been shown to have an oblong cross-sectional configuration, other configurations, including round or square or the like, are fully contemplated.

Having now described the invention relative to the drawings and specification in terms intended to enable a preferred practice of the several embodiments, claims are appended intended to define what is inventive.

We claim:

1. An impedance controlled connector for electrically interconnecting a pair of spaced apart components, where each said component is a composite formed by a substrate, a ground plane, a dielectric layer and micro strip line leads, where the thickness of the dielectric layer is selected relative to the dielectric constant of such layer so as to provide a precise impedance for said substrates, said connector comprising a conductive foil laminated to an insulating and dielectric film to provide a foil/film lamination, a tubular elastomeric body with the foil/film lamination being wrapped around the elastomeric body with first portions of the foil forming rows of signal and ground contacts positioned on the top and bottom surfaces of the said body to engage said micro strip line leads upon compression of said elastomeric body by said components, the foil including signal and ground leads extending between the top and bottom signal and ground contacts of the connector to electrically interconnect the components together, the foil including a second portion defining a ground plane with the spacing between the conductive portions of the signal and ground contacts and lead lines and the ground plane being selected to provide a given impedance relative to signals carried by the connector between the components, where the said contacts, lines and ground plane are formed from a foil on a common side surface of said film with the contacts and lines spaced from the said ground plane by a folding of the said film and foil.

2. The connector of claim 1 wherein the said second portion defining the ground plane is comprised of a lattice structure to increase the compliance of the connector through the cross-section thereof.

3. The connector of claim 1 wherein the said signal and ground contacts and lines are interdigitated in various signal to ground ratios to provide signal and ground paths side by side.

4. The connector of claim 1 wherein the film/foil lamination, in conjunction with the hardness characteristics of the elastomeric body and the dimensions thereof, is chosen to provide normal forces driving the contacts of the connector against contacts of components to provide a stable, low-resistance interface with the contacts of components.

5. An impedance controlled connector for electrically interconnecting a pair of spaced apart components, where each said component is a composite formed by a substrate, a ground plane, a dielectric layer and micro strip line leads, where the thickness of the dielectric layer is selected relative to the dielectric constant of such layer so as to provide a precise impedance for said substrates, said connector comprising a conductive foil laminated to an insulating and dielectric film to provide a foil/film lamination, tubular elastomeric body with the foil/film lamination being wrapped around the elastomeric body with first portions of the foil forming rows of signal and ground contacts positioned on the top and bottom surfaces of the said body to engage said micro strip line leads upon compression of said elastomeric body by said components, the foil including signal and ground leads extending between the top and bottom signal and ground contacts of the connector to electrically interconnect the components together, the foil including a second portion defining a ground plane with spacing between the conductive portions of the signal and ground contacts and lead lines and the ground plane being selected to provide a given impedance relative to signals carried by the connector between the components, where the said signal and ground contacts and leads are spaced from the said ground plane by a distance equal to twice the thickness of the said film with the film dielectric constant chosen to provide micro strip characteristics to the connector.

* * * * *